US006012978A

United States Patent [19]

Svensson et al.

[11] Patent Number: 6,012,978

[45] Date of Patent: Jan. 11, 2000

[54] DEVICE FOR REMOVAL OF EXHAUSTS FROM VEHICLES

[75] Inventors: Jan Roland Svensson, Landskrona; Kurt Lennarth Nordin, Helsingborg, both of Sweden

[73] Assignee: AB Ph. Nederman & Co., Helsingborg, Sweden

[21] Appl. No.: 09/123,837

[22] Filed: Jul. 28, 1998

[30] Foreign Application Priority Data

Aug. 4, 1997 [SE] Sweden ..... 9702850

[51] Int. Cl.[7] ..... B08B 15/02

[52] U.S. Cl. ..... 454/63; 104/52

[58] Field of Search ..... 454/63, 64; 104/52

[56] References Cited

U.S. PATENT DOCUMENTS 5,162,017 11/1992 Nordin .

FOREIGN PATENT DOCUMENTS 0459249 12/1991 European Pat. Off. .
457616 1/1989 Sweden .
89 08205 9/1989 WIPO .

*Primary Examiner*—Harold Joyce
*Assistant Examiner*—Derek S. Boles
*Attorney, Agent, or Firm*—Tarolli, Sundheim, Covell, Tummino & Szabo L.L.P.

[57] ABSTRACT

The present invention relates to a device for removal of exhausts from vehicles, which device includes a rail (3) which is mounted in premises in which the vehicle is located when its exhausts shall be removed. The rail (3) may be composed or put together of a plurality of rail members (19) of which each rail member (19) has a length which is similar to or somewhat less than the length of a standard-type pallet (21) so that all the rail members (19) of one rail (3) or several rails (3) can be transported on said pallet (21) in unassembled condition. Each rail member (19) has such coupling spaces in opposite end portions that coupling portions of coupling members (20) can be inserted into coupling spaces of two adjacent rail members (19). Coupling portions inserted into said coupling spaces and the rail members (19) in question can be attached to each other by means of fastening or mounting means (26) so that the rail members (19) and the coupling members (20) together define a rigid rail (3) along which the carriage (6) is displaceable or movable.

23 Claims, 5 Drawing Sheets

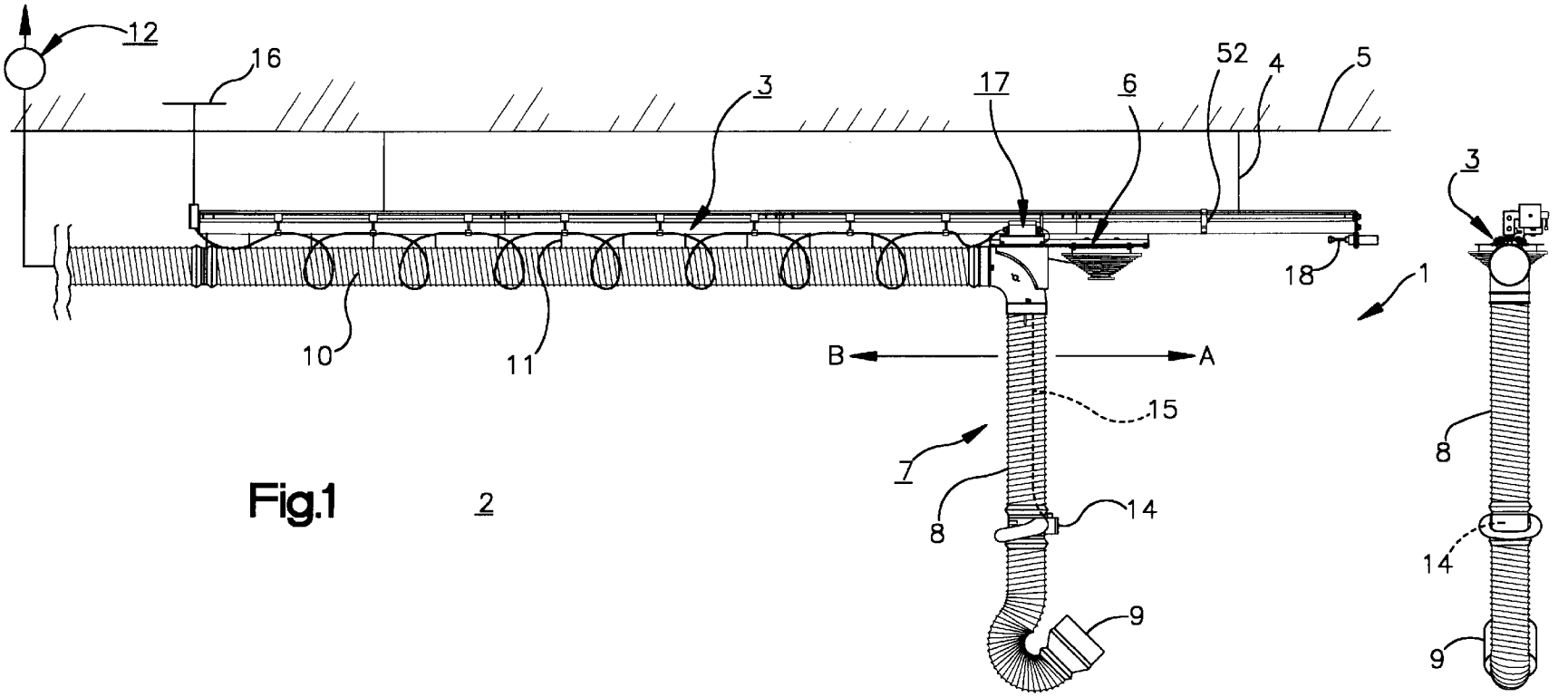
Fig.1
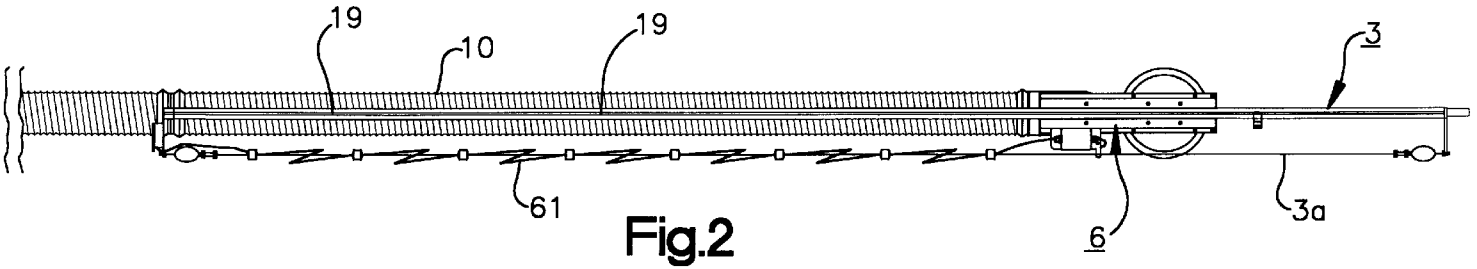
Fig.2
Fig.3

DEVICE FOR REMOVAL OF EXHAUSTS FROM VEHICLES

The present invention relates to a device for removal of exhausts from vehicles, whereby the device includes a rail which is mounted in premises in which the vehicle is located when its exhausts shall be removed, whereby a carriage is situated on the rail and provided with a hose or similar for removal of the exhausts and whereby the hose and/or vehicle has a retaining device which permits location thereof on the vehicle and/or its exhaust pipe such that a) the exhausts from the vehicle can be removed from the premises through the hose and b) the vehicle, through the hose, can drag the carriage along with it while driving in said premises.

Devices of the abovementioned type are known from EP-B-0,459,249. At these prior art devices, the rails for the carriage are long. This means that it is difficult to transport the rails from the factory to the premises where they shall be mounted, but also that it is difficult to mount said rails in said premises, since long rails are also heavy. Furthermore, the carriage has a supporting member on which brackets or carriers for wheels must be mounted. These wheels brackets or carriers can easily be mounted erroneously in relation to the supporting unit, which can result in that the wheels are positioned erroneously so that the wheels jam during driving. Also, there is no contactless disconnection of the hose from the vehicle.

The object of the present invention has been to eliminate these drawbacks. This is arrived at according to the invention by providing the initially defined device with the characterizing features of subsequent claim 1.

By providing the device with said characterizing features, it is permitted that the rail thereof becomes less bulky during transport and mounting, so that the costs therefor are substantially reduced.

The invention will be further described below with reference to the accompanying drawings, wherein FIG. 1 is a side view of a device according to the invention;

FIG. 2 is a plan view of the device according to FIG. 1;

FIG. 3 is a rear view of the device of FIG. 1;

Figure 5:
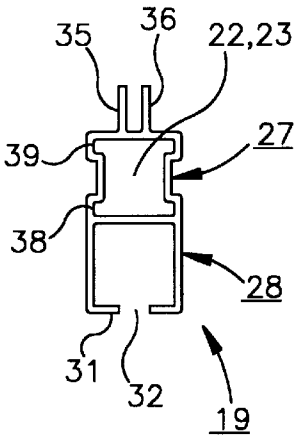
FIG. 5 is a front view of the rail member according to FIG. 4.
Figure 7:
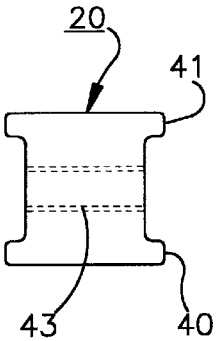
FIG. 7 is a front view of the coupling member of FIG. 6.
Figure 4:
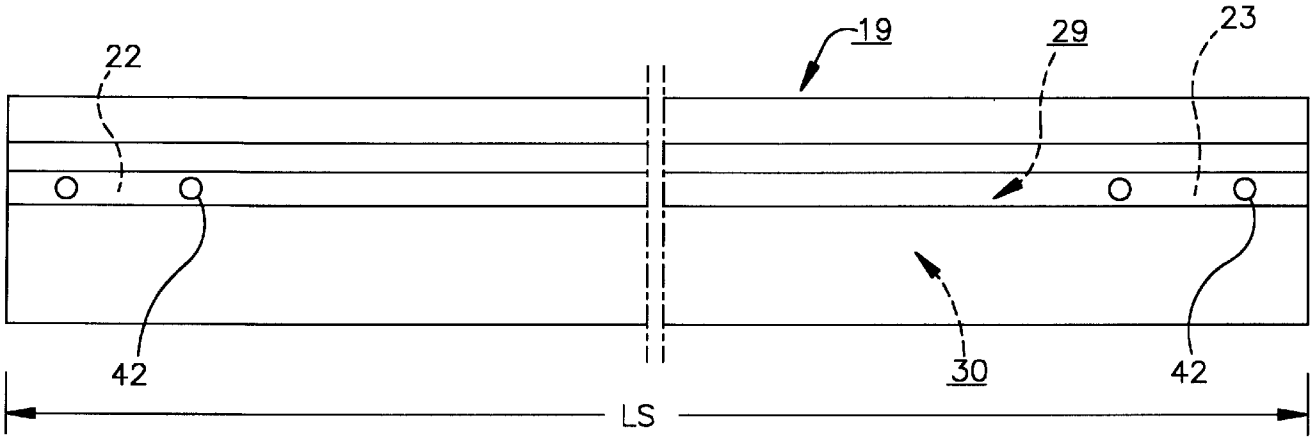
FIG. 4 is a side view of a rail member forming part of the device of FIG. 1.
Figure 6:
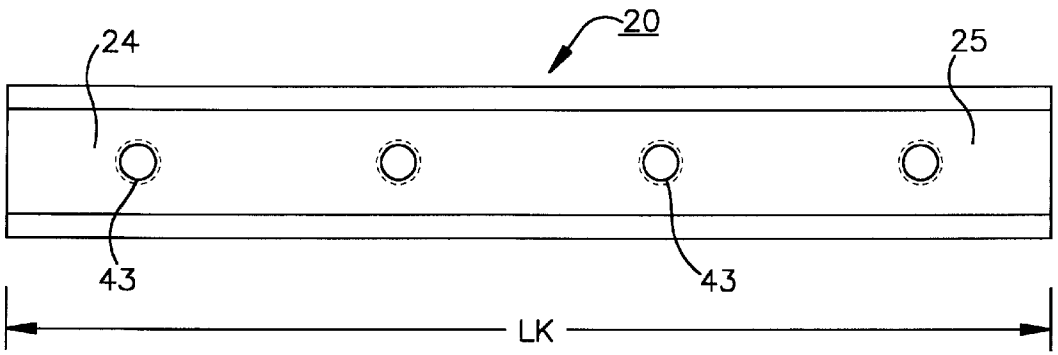
FIG. 6 is a side view of a coupling member forming part of the device according to the invention.
Figure 8:
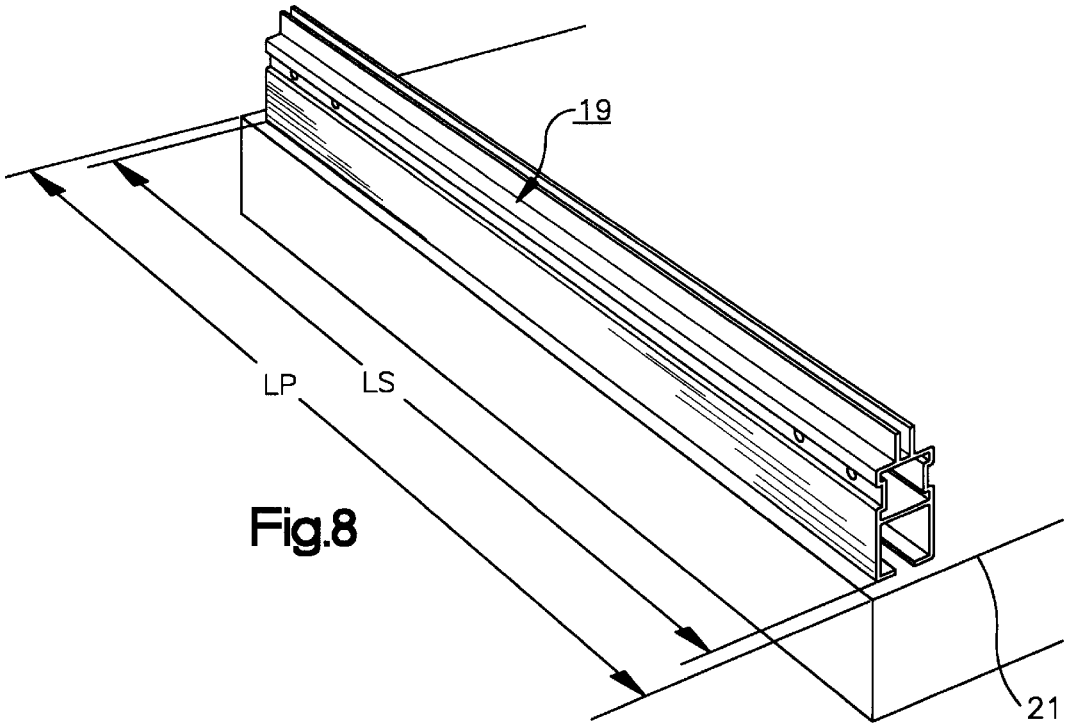
FIG. 8 is a perspective view of the rail member forming part of the device according to the invention and located on a pallet.

The device 1 illustrated in the drawings is located in premises 2, e.g. a fire station, and adapted for removal of exhausts from vehicles (not shown), e.g. fire-fighting vehicles, in said premises 2. The device 1 includes a rail 3 which through rods 4 is suspended from the ceiling 5 in said premises 2. The rail 3 is located in parallel with a driving path along which the vehicle can be driven in said premises between a parking site and a gate through which the vehicle can be driven into and out of said premises. On the rail 3 there is provided a carriage 6 which can be moved along the rail 3 and which includes a hose 7 for removing the exhausts from the vehicle. The hose 7 has a part 8 depending from the carriage 6 and including an end portion 9, which can be located in such a relationship to the exhaust pipe (not shown) of the vehicle that exhausts discharged from the exhaust pipe can be removed through the hose 7. The hose 7 further includes a part 10 which communicates with the dependent part 8 thereof and which is connected to the carriage 6. Said part 10 is suspended on the rail 3 through suspension means 11 which are journalled on the rail 3 such that they can be moved along said rail. Furthermore, part 10 is preferably connected to a fan system 12 which generates a negative pressure in the hose 7 for facilitating removal of the exhausts.

On the dependent part 8 of the hose 7 there is provided an electrically controlled retaining device 14, e.g. an electromagnet, forming part of an electric circuit 15 which through a connection 16 is connected to the mains. The magnetic power of the electromagnet 14 can retain the electromagnet 14 at a keeper (not shown) or any other part of or on the vehicle, whereby the end portion 9 of the hose 7 may be located in said relationship to the exhaust pipe wherein said end portion 9 can receive exhausts from the exhaust pipe of the vehicle for removal or discharge thereof through the hose 7. The electromagnet 14 and the end portion 9 are adapted to maintain said positions when the vehicle is parked or driven in said premises 2. During driving of the vehicle along the rail 3 towards the gate, the vehicle will then drag the carriage 6 along with it along the rail 3 (in the direction of arrow A) via the electromagnet 14 and the lower part 8 of the hose 7. Hereby, part 10 of the hose 7 will be extended and its suspension means 11 displaced or moved along the rail 3. A disconnecting device 17 is provided to disconnect or switch off the current to the electromagnet 14 when the carriage 6 during said displacement or movement along the rail 3 reaches a certain position on said rail. While the electromagnet 14 becomes currentless in this way, it loosens from the keeper on the vehicle. The movement of the carriage 6 along the rail 3 can be stopped by a buffer 18 at the end of the rail 3 and the vehicle can drive out of the premises 2 through the gate, released from the hose 7.

The rail 3 consists of rail members 19 which can be mounted to each other by means of coupling members 20. Each rail member 19 has a length LS equivalent with or somewhat less than the length LP of a standard-type pallet 21, preferably a pallet 21 of Europe-pallet type. The length LP of a Europe-pallet is set to 1200 mm and if such a standard-type pallet is used for transporting rail members 19, these rail members may have a length LS of 1180 mm. Other standard-type pallets than Europe-pallets with other lengths exist and if so, the length LS of the rail members 19 is adapted thereto.

Since the length LS of the rail members 19 has been adapted to the length LP of standard-type pallets 21 in said manner, rail members 19 for one or more rails 3 can be transported on a standard-type pallet 21 in an unassembled condition, which means that the prices for transporting the rail members 19 become substantially lower than if you have to transport rail members having greater lengths. Short rail members 19 also have the advantage that they are easy to handle during loading, unloading and assembly. The coupling members 20 have a less length LK than the rail members 19 so that there is room also for the coupling members 20 on the standard-type pallet 21.

Each rail member 19 has such coupling spaces 22, 23 in opposite end portions that coupling portions 24, 25 of the coupling member 20 can be moved into or inserted in coupling spaces 22, 23 in two adjacent rail members 19. When the coupling portions 24, 25 of the coupling member 20 have been inserted in said coupling spaces 22, 23, the coupling member 20 and the rail members 19 can be attached to each other by fastening or mounting means 26 so that said coupling members 20 and rail members 19 together define a rigid rail 3 along which the carriage 6 is movable.

The coupling spaces 22, 23 are defined preferably by upper portions 27 of the rail members 19, which beneath said upper portions 27 have lower portions 28 in which the carriage 6 is suspended. The upper portions 27 consist of an upper pipe 29 and the lower portions 28 of a lower pipe 30 which extends along the entire rail member 19 and which at an underside 31 has a longitudinal slit 32 through which wheel-carrying members 33 of the carriage 6 can engage the lower pipe 30 so that wheels 34 on said wheel-carrying members 33 can be situated inside said lower pipe 30 and run on the underside 31 on opposite sides of the slit 32. The suspension means 11 for part 10 of the hose 7 can also engage the lower pipe 30 through the slit 32 and be journalled so that they can slide on the underside 31 on opposite sides of the slit 32.

Figure 9:
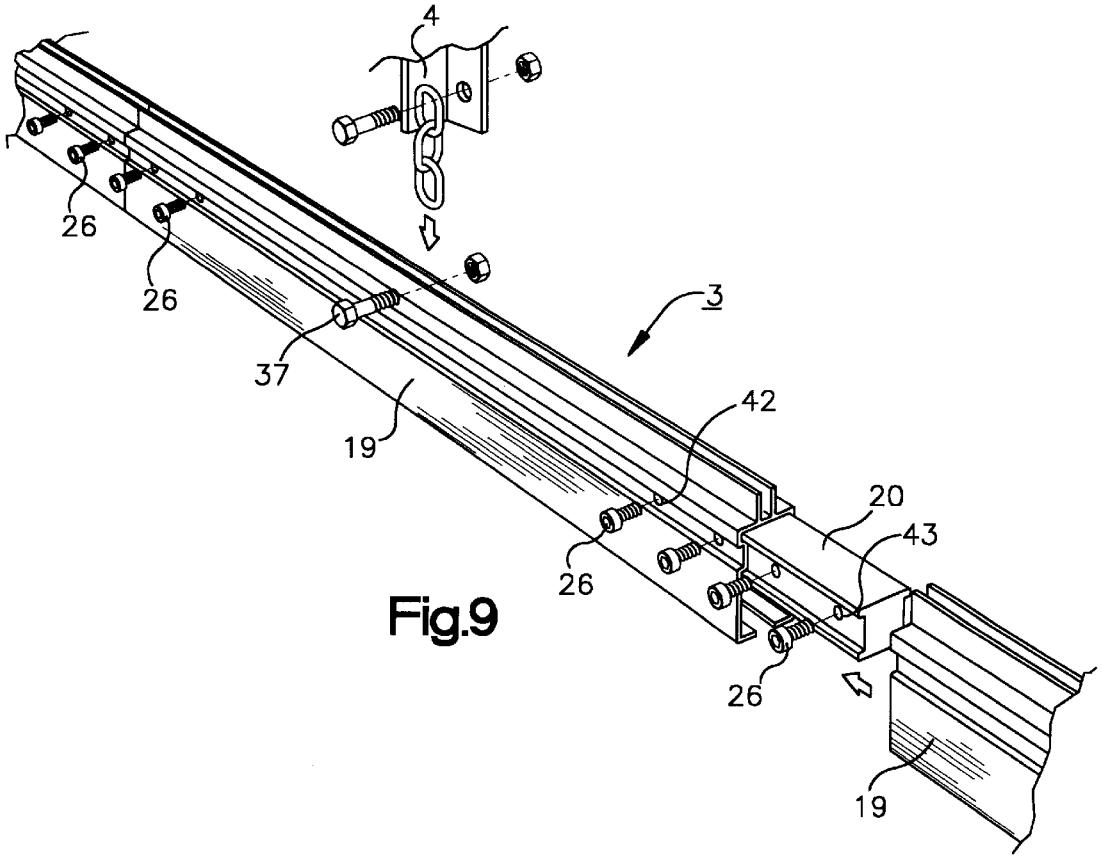
FIG. 9 illustrates with a perspective and exploded view how several rail members according to FIG. 8 are mounted.
Figure 12:
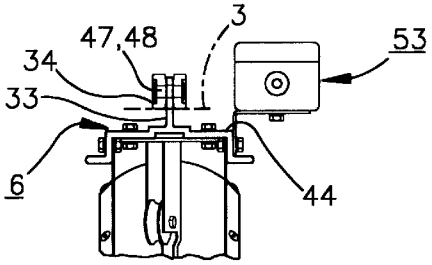
FIG. 12 is a front view of the carriage of FIG. 10.
Figure 13:
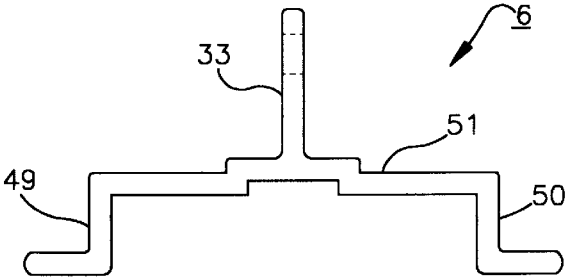
FIG. 13 is a front view of a supporting member forming part of the carriage of FIG. 10.
Figure 10:
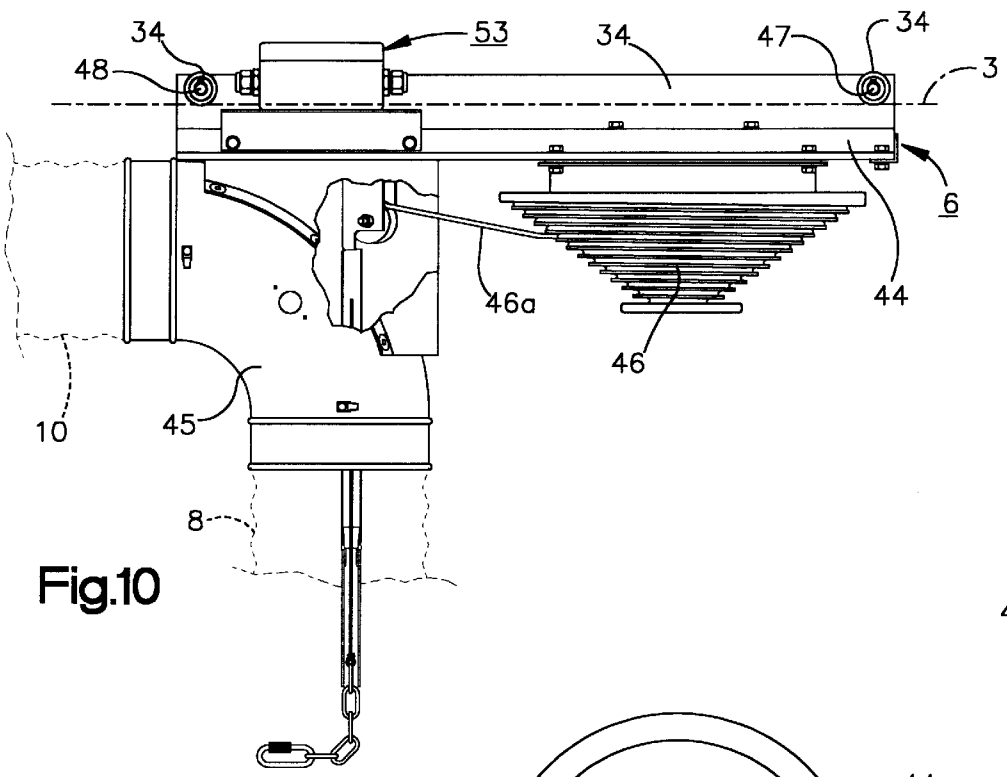
FIG. 10 is a side view of a carriage forming part of the device according to the invention.
Figure 11:
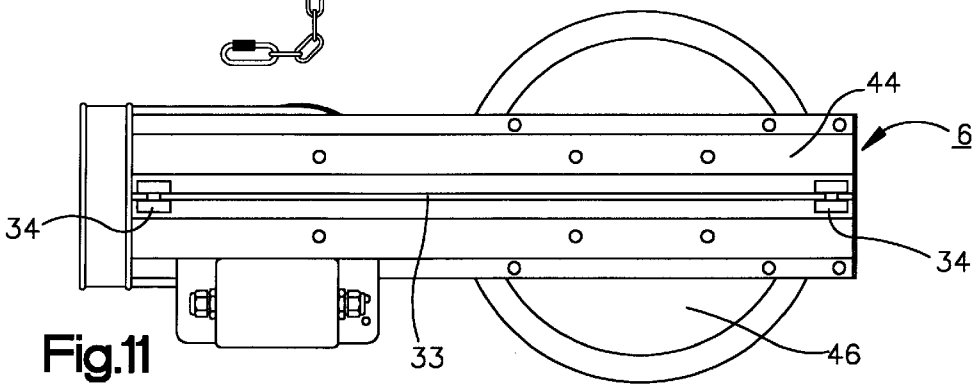
FIG. 11 is a plan view of the carriage of FIG. 10.

The upper portions 27 of the rail members 19 may have one or more upwardly directed flanges 35, 36. During assembly, holes can be drilled through these flanges at suitable locations for attaching the rail members 19 by means of a bolt 37 (FIG. 9) or a similar mounting means to a rod 4 or vice versa. The flanges 35, 36 extend preferably along the entire upper pipe 29 and define thereby stiffening portions of the rail members 19.

The rail members 19 can be extruded hollow profiles (FIG. 5) of preferably aluminium.

The coupling portions 24, 25 of the coupling members 20 are designed to fit well into the coupling spaces 22, 23 of the rail members 19 so that no substantial play exists between the rail members 19 and the coupling members 20. The coupling spaces 22, 23 of the rail members 19 can down below and on top be provided with extended portions 38, 39. The coupling portions 24, 25 of the coupling members 20 can down below and on top be provided with corresponding extended portions 40, 41 which can be adapted to the extended portions 38, 39 of the coupling spaces 22, 23 so that a stable joint or bond is obtained between the rail members 19 and the coupling members 20.

The rail members 19 as well as the coupling members 20 preferably have predrilled holes 42 and 43 respectively, which are located so that the coupling members 20 hold the rail members 19 close to each other in a firm grip when the bolts 26 have been inserted into said holes 42, 43 and tightened.

The coupling members 20 may be extruded profiles, preferably of aluminium, and may be solid in their entire length.

The carriage 6 consists of said wheel-carrying members 33 and of a supporting member 44. On the supporting member 44 there is provided a bent pipe piece 45, which on its downwardly directed end carries hose part 8 and which on its laterally directed end carries hose part 10. The interiors of said hose parts 8, 10 communicate through said pipe piece 45 and the exhausts pass therethrough during removal of said exhausts.

The supporting member 44 further comprises a hose reel device 46 for reeling, through a line or wire 46*a*, the dependent part 8 of the hose 7 a distance when said part 8 has loosened from the vehicle.

The supporting member 44 and wheel-carrying members 33 of the carriage 6 are made in one piece in order to ensure that the wheels 34 are placed in and maintain predetermined positions relative to the supporting member 44 and/or relative to each other.

On the wheel-carrying members 33 there are provided two shafts 47, 48 for two pairs of wheels 34 and these shafts 47, 48 are preferably located one in each end of the carriage 6.

The supporting member 44 of the carriage may preferably have a U-profile, whereby the shanks 49, 50 are directed downwards and the wheel-carrying members 33 consist of a flange protruding upwards from the web portion 51.

The supporting member 44 and the wheel-carrying members 33 may consist of an extruded profile of preferably aluminium.

The disconnecting device 17 for disconnecting or loosening the electromagnet 14 from the vehicle, comprises a disconnecting magnet 52 provided on or at the rail 3, and a disconnecting unit 53 mounted on the carriage 6. The disconnecting unit 53 is provided to disconnect or switch off the current to the electromagnet 14 and thereby bring hose part 8 to loosen from the vehicle when said disconnecting unit 53 cooperates with the disconnecting magnet 52 when said unit 53 passes said magnet 52 during displacement of the carriage 6 along the rail 3 in direction A. Furthermore, the disconnecting unit 53 is provided not to disconnect or switch off the current to the electromagnet 14 when said disconnecting unit 53 passes the disconnecting magnet 52 during displacement of the carriage 6 along the rail 3 in an opposite direction B.

The disconnecting magnet 52 and disconnecting unit 53 cooperate preferably contactless with each other.

The disconnecting unit 53 may comprise two sensing members 54, 55 which can cooperate with the disconnecting magnet 52 so that the current to the electromagnet 14 is switched off when a first sensing member 54 passes the disconnecting magnet 52 before the second sensing member 55 when the carriage 6 is displaced or moved in direction A during driving of the vehicle out of the premises 2, but that the current to the electromagnet 14 is not switched off when said second sensing member 55 passes the disconnecting magnet 52 before said first sensing member 54 when the carriage is moved in the opposite direction B.

The disconnecting magnet 52 can be placed in different positions along the rail 3, so that the disconnecting point in the premises 2 at which the electromagnet 14 shall loosen from the vehicle can vary.

The disconnecting magnet 52 can be a permanent magnet which is placed in a holder 56 that is displaceably mounted on the rail 3.

Figure 14:
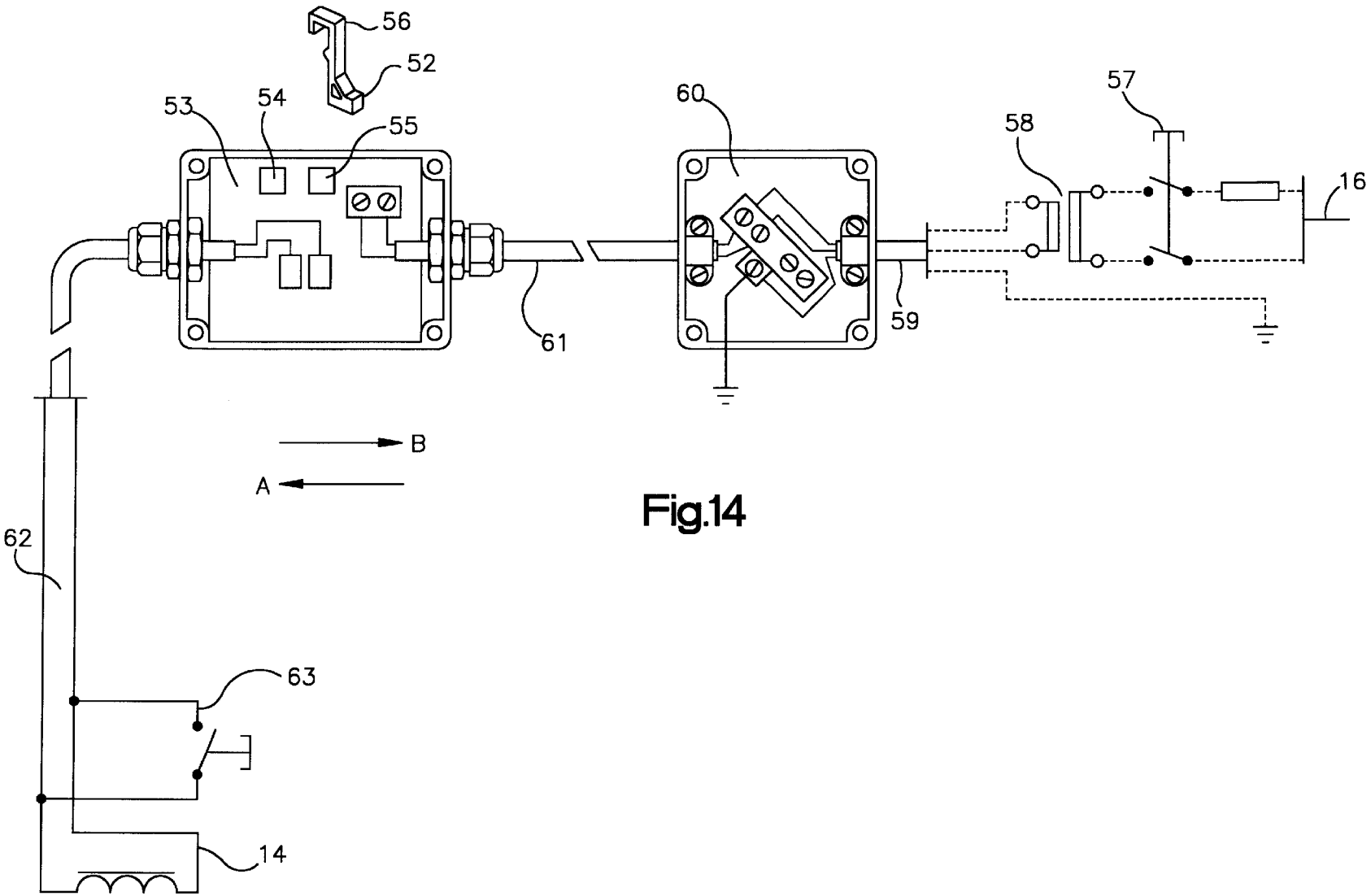
FIG. 14 is a wiring diagram of a disconnection device forming part of the device of FIG. 1.

In FIG. 14 there is shown a wiring diagram over the electric circuit 15 in which the electromagnet 14 forms a part. Said electric circuit 15 comprises, closest to the mains connection 16, a service breaker 57 and a protective transformer 58 which through cables 59 are connected to a connection box 60. The connection box 60 is through cables 61 connected to the disconnecting unit 53 and these cables 61 may be suspended in a line or wire 3*a* extending along the rail 3.

The disconnecting unit 53, including the sensing members 54, 55, is mounted on the carriage 6 and through cables 62 connected to the electromagnet 14. These cables 62 also include a manually operable switch 63.

The present invention is not limited to the embodiments defined above, but may vary within the scope of the following claims. As alternatives not shown can be mentioned that the hose 7 can be completely or partially replaced by a pipe with suitable properties, the retaining device may be of another type than the one described and the carriage 6 may be of another type than the one described. Additionally, the retaining device 14 may be of another type than an electromagnet.

We claim:

1. A device for removing vehicle exhaust, said device comprising:

a rail mounted in a premises in which a vehicle needing exhaust removal is located;

a carriage situated on the rail which carriage is movable along the length of the rail;

a hose situated on said carriage for removing the vehicle exhaust;

a retaining device located on the hose and/or vehicle, the retaining device permitting connection of the hose on the vehicle and/or its exhaust pipe such that:

a) the exhausts from the vehicle can be removed from the premises through the hose, and b) the vehicle, through the hose, can drag the carriage along the length of the rail while driving in the premises, characterized by the fact that the rail is composed of a plurality of rail members, said rail members having a length (LS) which is the same as or up to 20 mm shorter than the length (LP) of a standard-type pallet, preferably a Europe-pallet with a length (LP) of 1200 mm, so that all rail members that comprise one rail or several rails are transportable on said pallet in an unassembled condition, said rail members being connectable to each other by means of coupling members which are shorter in length than the rail members, each rail member having coupling spaces in opposite end-portions so that each coupling end-portion of each coupling member can be inserted into coupling spaces of two adjacent rail members, and the coupling portions, when inserted into said coupling spaces, are attachable to the rail members by means of fastening or mounting means so that the rail members and the coupling members together define a rigid rail along which the carriage is movable, and further characterized by the fact that said coupling spaces for said coupling members are defined by an upper portion of the rail members, and further characterized by the fact that the rail members include a lower portion in which the carriage is suspended.

2. A device as claimed in claim 1, wherein the upper portion of the rail members consist of an upper pipe which extends along the entire rail member, and the lower portions of the rail members consist of a lower pipe which extends along the entire rail member, each lower portion further consisting of a longitudinal slit located on an underside of the lower portion, and the wheel-carrying members of the carriage being engageable through said slit located on the underside of said lower pipe, the wheels on said wheel-carrying members being situated inside the lower pipe and run along the underside of said lower pipe on opposite sides of the slit.

3. A device as claimed in claim 2, wherein the suspension means for a descending portion of the hose are engageable through the slit located on the underside of the lower pipe, and the suspension means are journaled on the underside of the lower pipe on opposite sides of the slit such that the suspension means are movable along the underside of the rail.

4. A device as claimed in claim 1, wherein the upper portions of the rail members presents one or more upwardly directed flanges, the flanges being connectable to a rod through which the rail members can be mounted, preferably onto a ceiling in the premises.

5. A device as claimed in claim 4, wherein the flanges extend along the entire rail member.

6. A device as claimed in claim 1, wherein the coupling portions of the coupling members are designed to fit into the coupling spaces of the rail members so that no substantial play is present between the rail members and the coupling members.

7. A device as claimed in claim 1, wherein the coupling spaces of the upper portion of the rail members have extended portions at the top and at the bottom, and the coupling portions of the coupling members are provided with corresponding extended portions at the top and at the bottom which fit into said extended portions of the rail members, and each coupling member preferably being solid in its entire length.

8. A device as claims in claim 1, wherein the fastening or mounting means are bolts, and the rail members as well as the coupling members have pre-drilled holes for said mounting means, and the coupling members hold the rail members close to each other in a first grip when the mounting means have been inserted into the holes and tightened.

9. A device as claimed in claim 1, wherein the rail members and coupling members consist of extruded aluminum.

10. A device as claimed in claim 1, wherein the carriage comprises a supporting member carrying or supporting the hose, and the carriage further comprises wheel-carrying members having wheels enabling the carriage to roll along the length of the rail, and further characterized by the supporting member and the wheel-carrying members of the carriage being manufactured as one piece.

11. A device as claimed in claim 1, wherein the retaining device is electrically operated, and wherein a disconnecting device is provided to disconnect or switch off the current to the retaining device so that the retaining device loosens from the vehicle, said disconnecting device comprising a disconnecting magnet located on or at the rail and a disconnecting unit mounted on the carriage, said disconnecting unit being provided to switch off or break the current to the retaining device and thereby loosen the hose from the vehicle when the disconnecting unit cooperates with a disconnecting magnet as the disconnecting unit passes by the retaining device during movement of the carriage along the rail in a direction (A), and the disconnecting unit is provided not to switch off or break the current to the retaining device when said disconnecting unit passes by the disconnecting magnet during displacement or movement of the carriage along the rail in an opposite direction (B).

12. A device for removing vehicle exhaust, said device comprising:

a rail mounted in a premises in which a vehicle is located;

a carriage situated on the rail which carriage is movable along the length of the rail;

a hose situated on the carriage for removing the vehicle exhaust;

a retaining device located on the hose and/or vehicle which permits location of the hose on the vehicle and/or its exhaust pipe such that:

a) the exhausts from the vehicle can be removed from premises through the hose, and b) the vehicle, through the hose, can drag the carriage along the length of the rail while driving in the premises, characterized by the fact that the carriage comprises a supporting member carrying or supporting the hose, said carriage further comprising wheel-carrying members having wheels on which the carriage rolls along the length of the rail, said supporting member and said wheel-carrying members of the carriage being manufactured as one piece.

13. A device as claimed in claim 12, wherein the shafts for two wheels are provided on the wheel-carrying members.

14. A device as claimed in claim 12, wherein the wheel-carrying members of the carriage consist of at least one flange protruding upward from the supporting member.

15. A device as claimed in claim 12, wherein the supporting member of the carriage has partly the shape of a U-profile, whereby shanks are directed downwards and the wheel-carrying members are provided on a web member.

16. A device as claimed in claim 12, wherein the supporting member and the wheel-carrying members consist of an extruded profile, preferably of aluminum.

17. A device as claimed in claim 12 wherein the rail may be composed of a plurality of rail members of which each rail member has a length (LS) which is the same as or up to 20 mm shorter than the length (LP) of a standard-type pallet, preferably a Europe-pallet with a length (LP) of 1200 mm so that all the rail members of one rail or several rails can be transported on said pallet in unassembled condition, the rail members being mountable to each other by means of coupling members which are shorter than said rail members, each rail member has such coupling spaces in opposite end portions so that each coupling end-portion of each coupling member can be inserted into coupling spaces of two adjacent rail members, said coupling portions being insertable into said coupling spaces, and said rail members being attachable to each other by means of fastening or mounting means so that said rail members and said coupling members together define a rigid rail along which the carriage is movable.

18. A device for removing vehicle exhaust, said device comprising:

a rail mounted in a premises in which a vehicle is located;

a carriage situated on the rail and a hose on said carriage for removing the exhausts;

a retaining device located on the hose and/or vehicle which permits location of said hose on the vehicle and/or its exhaust pipe such that:

a) exhausts from the vehicle can be removed from the premises through the hose, and b) the vehicle, through the hose, can drag the carriage along the length of the rail while driving in the premises; and characterized by the fact that the retaining device is electrically operated for enabling attachment thereof to the vehicle; and a disconnecting device is provided to disconnect or switch off the current to the retaining device so that it disconnects from the vehicle, said disconnecting device comprising a disconnecting magnet located on or at the rail and a disconnecting unit mounted on the carriage, said disconnecting unit is provided to switch off or break the current to the retaining device and thereby disconnect the hose from the vehicle when the disconnecting unit cooperates with the disconnecting magnet when said disconnecting unit passes by said disconnecting magnet during movement of the carriage along the rail in a direction (A), and the disconnecting unit is provided not to switch off or break the current to the retaining device when said disconnecting unit passes by the disconnecting magnet during movement of the carriage along the rail in an opposite direction (B).

19. A device as claimed in claim 18, wherein the disconnecting magnet and disconnecting unit cooperate contactless with each other.

20. A device as claim in claim 18, wherein the disconnecting unit comprises two sensing members which can cooperate with the disconnecting magnet so that the current to the retaining device is switched off when a first sensing member passes by the disconnecting magnet before a second sensing member when the carriage is moved in a direction (A) during driving of the vehicle out of the premises, and wherein the current to the retaining device is not switched off when said second sensing member passes the disconnecting magnet before said first sensing member when the carriage is moved in an opposite direction (B).

21. A device as claimed in claim 18, wherein the disconnecting magnet can be placed in different positions along the rail so that the disconnecting point in the premises at which the retaining device shall loosen from the vehicle being variable.

22. A device as claimed in claim 18, wherein the disconnecting magnet is a permanent magnet which is placed in a holder that is displaceably mounted on the rail.

23. A device as claimed in claim 18, wherein the retaining device comprises an electromagnet which can be attached to the vehicle by its magnetic attraction.

* * * * *